US007586452B2

(12) United States Patent
Li et al.

(10) Patent No.: US 7,586,452 B2
(45) Date of Patent: Sep. 8, 2009

(54) MULTI-BAND ANTENNA

(75) Inventors: Qian Li, Ann Arbor, MI (US); Wladimiro Villarroel, Ypsilanti, MI (US); Nuttawit Surittikul, Bangkok (TH); Masaru Shiina, Kanagawa (JP); Kwan-ho Lee, Ann Arbor, MI (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 99 days.

(21) Appl. No.: 11/874,733

(22) Filed: Oct. 18, 2007

(65) Prior Publication Data

US 2008/0169989 A1 Jul. 17, 2008

Related U.S. Application Data

(60) Provisional application No. 60/884,945, filed on Jan. 15, 2007.

(51) Int. Cl.
*H01Q 1/32* (2006.01)

(52) U.S. Cl. ..... 343/713; 343/725; 343/767

(58) Field of Classification Search ..... 343/713, 343/725, 767

See application file for complete search history.

(56) References Cited

U.S. PATENT DOCUMENTS

| | | | |
|---|---|---|---|
| 4,072,953 | A | 2/1978 | Comastri et al. |
| 4,072,954 | A | 2/1978 | Comastri et al. |
| 4,090,202 | A | 5/1978 | Comastri et al. |
| 4,527,164 | A | 7/1985 | Cestaro et al. |
| 4,823,142 | A | 4/1989 | Ohe et al. |
| 5,418,543 | A | 5/1995 | Bolton |
| 5,646,637 | A | 7/1997 | Miller |
| 5,650,791 | A | 7/1997 | Talty |
| 5,659,324 | A | 8/1997 | Taniguchi et al. |
| 5,663,797 | A | 9/1997 | Kakizawa |
| 5,675,347 | A | 10/1997 | Terashima et al. |
| 5,825,335 | A | 10/1998 | Arai et al. |
| 5,926,141 | A | 7/1999 | Lindenmeier et al. |
| 6,054,961 | A | 4/2000 | Gong et al. |
| 6,097,345 | A | 8/2000 | Walton |
| 6,140,969 | A | 10/2000 | Lindenmeier et al. |
| 6,150,985 | A | 11/2000 | Pritchard |
| 6,172,651 | B1 | 1/2001 | Du |
| 6,184,836 | B1 | 2/2001 | Ali |
| 6,307,511 | B1 | 10/2001 | Ying et al. |
| 6,362,784 | B1 | 3/2002 | Kane et al. |
| 6,369,768 | B1 | 4/2002 | Fusinski |
| 6,480,162 | B2 | 11/2002 | Sabet et al. |
| 6,486,840 | B1 | 11/2002 | Buren |
| 6,608,597 | B1 | 8/2003 | Hadzoglou et al. |

(Continued)

FOREIGN PATENT DOCUMENTS

| | | | |
|---|---|---|---|
| EP | 1732160 | A1 | 12/2006 |

*Primary Examiner*—Tan Ho
(74) *Attorney, Agent, or Firm*—Howard & Howard Attorneys PLLC

(57) ABSTRACT

An antenna is integrated with a window of a vehicle primarily for operating in multiple cellular telephone frequency bands. The antenna includes a conductive area formed of conductive material defining a slot. The slot is dimensioned such that edges adjacent the slot radiate primarily in a first frequency band. The antenna also includes a conductive strip formed of conductive material extending from the conductive area. The conductive strip is dimensioned to radiate primarily in a second frequency band.

25 Claims, 5 Drawing Sheets

U.S. PATENT DOCUMENTS 6,664,932 B2 12/2003 Sabet et al.
6,693,597 B2 2/2004 Walton et al.
6,741,214 B1 * 5/2004 Kadambi et al. ..... 343/700 MS
6,828,939 B2 12/2004 Li
6,917,335 B2 7/2005 Kadambi et al.
6,946,997 B2 9/2005 Imaizumi et al.
7,164,387 B2 1/2007 Sievenpiper
7,233,296 B2 * 6/2007 Song et al. ..... 343/713
7,230,571 B2 7/2007 Gaucher et al.
7,242,352 B2 * 7/2007 Tavassoli Hozouri . 343/700 MS
7,242,357 B2 7/2007 Fujii et al.
7,242,358 B2 7/2007 Noh
7,265,726 B2 9/2007 Kenoun et al.

* cited by examiner

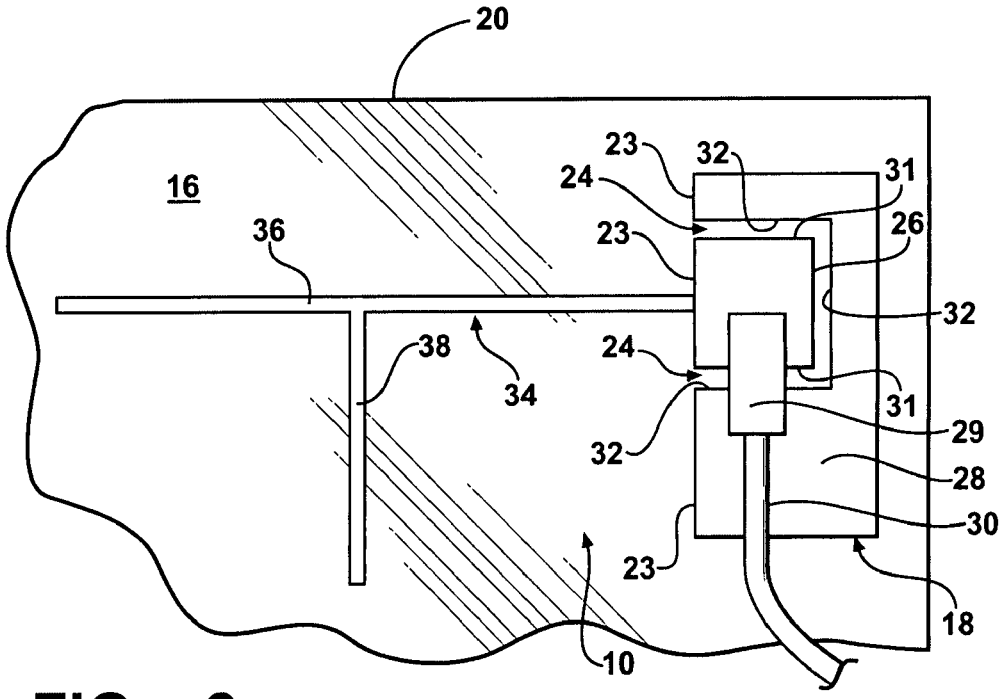
FIG - 2
FIG - 3
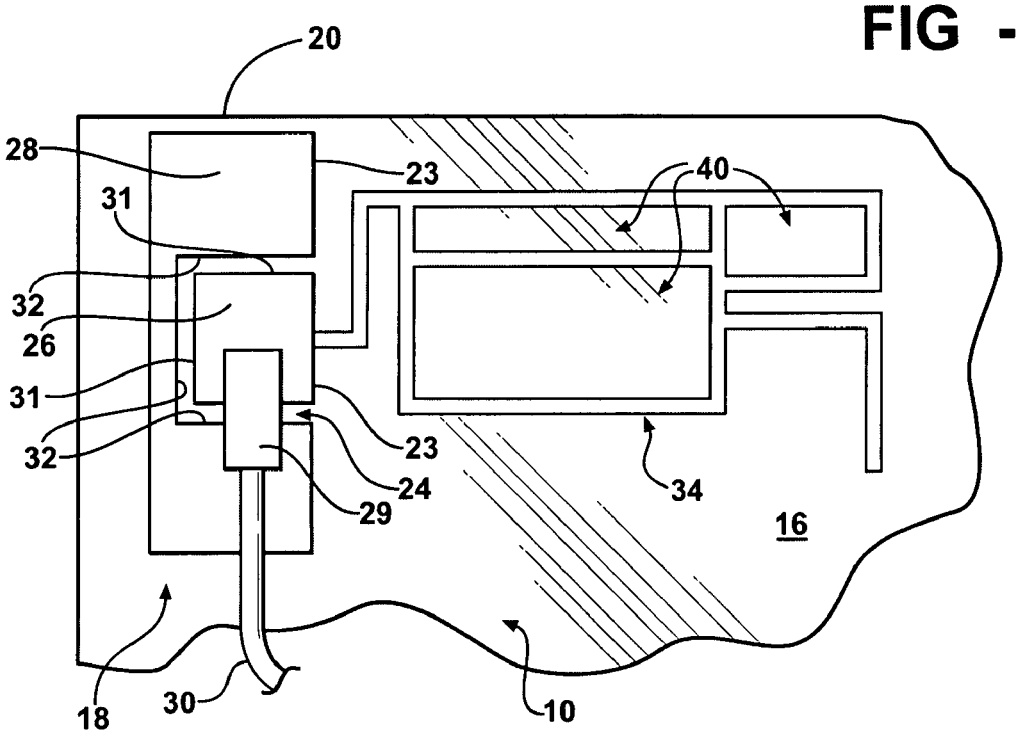

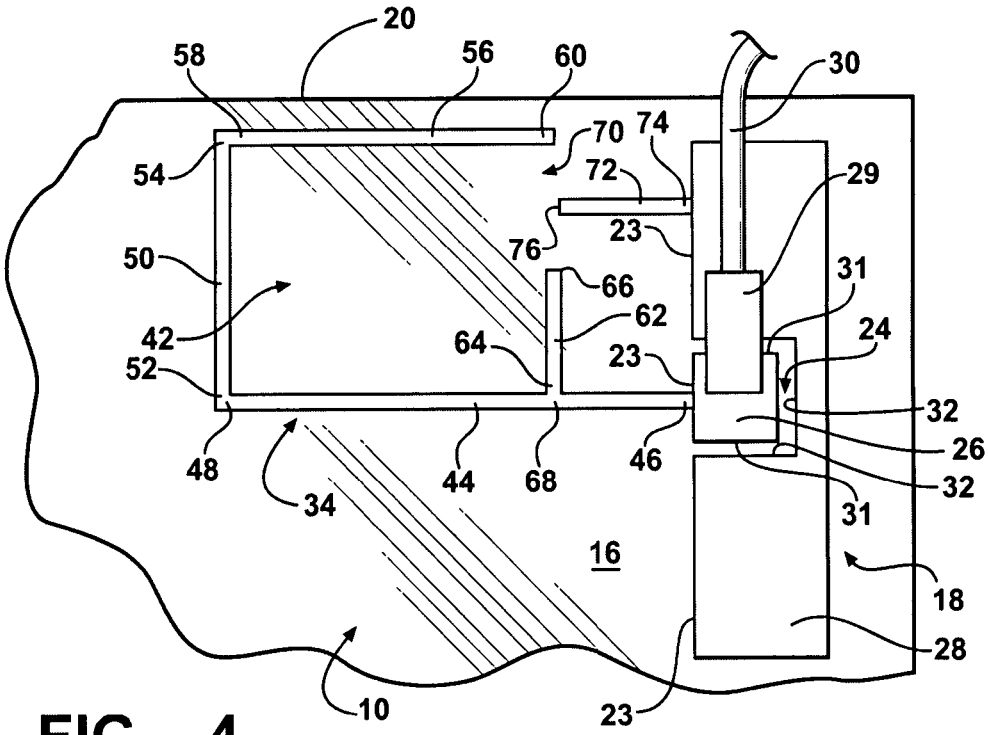
FIG - 4
FIG - 5
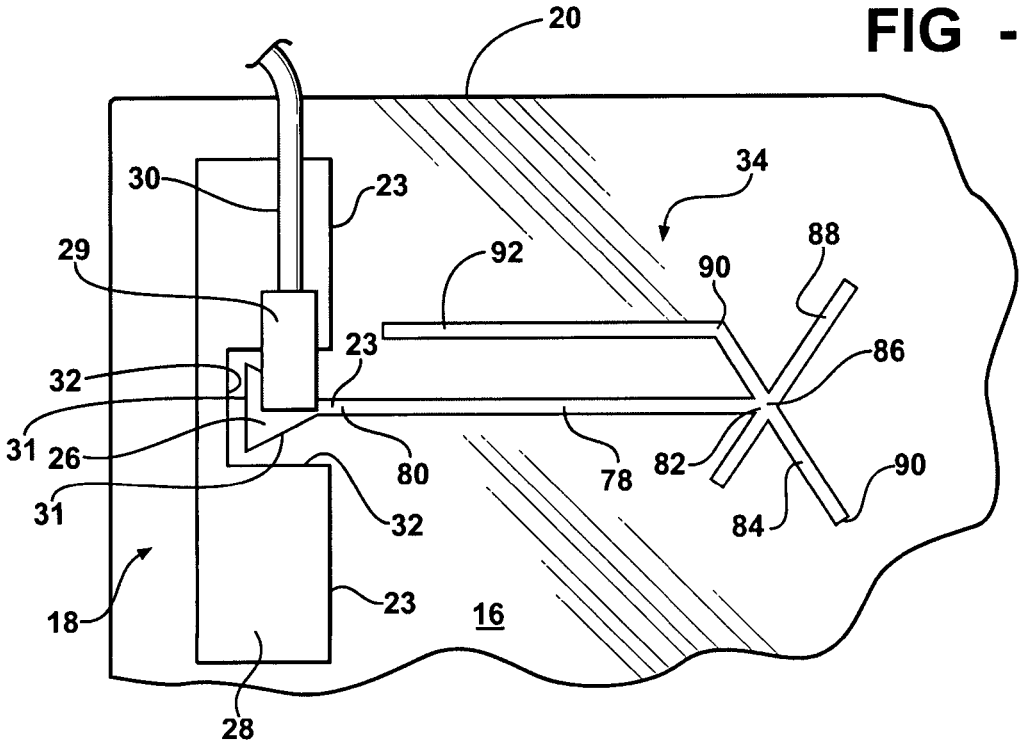

MULTI-BAND ANTENNA

CROSS REFERENCE TO RELATED APPLICATION

This application claims the benefit of U.S. Provisional Application No. 60/884,945 filed Jan. 15, 2007, which is hereby incorporated by reference.

BACKGROUND OF THE INVENTION

1. Field of the Invention

The invention generally relates to a multi-band antenna and specifically to such an antenna integrated in a window. The invention also relates to an antenna for use on multiple cellular telephone bands.

2. Description of the Related Art

Antennas are commonly integrated in vehicle windows to reduce and/or negate the need for vertical rod antennas (e.g., mast or whip antennas) that project from various surfaces of the vehicle. By utilizing antennas integrated in windows, vehicle manufacturers obtain aesthetically pleasing and streamlined vehicle exteriors as well as reduced wind resistance. Unfortunately, performance of these window integrated antennas has often been deficient. Furthermore, placement of these antennas on glass often obstructs the view of a driver of the vehicle.

An antenna suitable for receiving and transmitting on cellular telephone bands is disclosed in U.S. Pat. No. 4,914,447 (the '447 patent). The antenna of the '447 patent includes a plurality of conductive strip segments arranged in a "U-shape" and an "inverted L-shape" connected to the "U-shape". This antenna functions in a cellular telephone band of 860 MHz to 940 MHz. Unfortunately, the antenna does not perform in other cellular telephone bands.

U.S. Pat. No. 4,072,954 (the '954 patent) discloses a dual-band antenna. The antenna is formed of conductive strip segments disposed on a window. The conductive strip segments form a pair of dipole legs, with each leg forming an open loop. The conductive strip segments also form a vertical section disposed between the dipole legs. The antenna of the '954 patent operates primarily in the AM/FM broadcast frequency ranges, and not in the cellular telephone frequency ranges. Furthermore, the antenna of the '954 patent occupies a significant area on the window, thus obstructing the view of the driver.

There remains an opportunity for a dual-band antenna, primarily for cellular telephone use, that may be integrated with a window without significantly obstructing the view of the driver.

SUMMARY OF THE INVENTION AND ADVANTAGES

The subject invention is an antenna including a conductive area formed of conductive material. The conductive area includes at least one peripheral side. The conductive area also defines a slot interrupting the peripheral side to divide the conductive area into a first section and a second section. The second section is spaced from and at least partially surrounds the first section. The first section includes at least one edge adjacent to the slot and the second section includes at least one edge adjacent to the slot. The edges adjacent to the slot are dimensioned for radiating primarily in a first frequency band. The antenna also includes a conductive strip formed of conductive material. The conductive strip is disposed generally co-planar with the conductive area. The conductive strip is connected to the first section along the peripheral side. The conductive strip is dimensioned for radiating primarily in a second frequency band. In the subject invention, the antenna may be integrated with a window. Specifically, the area of conductive material and the strip of conductive material may be disposed on a transparent, non-conductive pane.

The antenna provides numerous advantages. First and foremost, the antenna is an effective radiator on multiple frequency bands, particularly multiple cellular telephone bands. Furthermore, when integrated with a window of a vehicle, the antenna has a pleasing aesthetic appearance which is virtually unnoticeable to the driver of the vehicle and thus does not impede the driver's vision through the window. Also, the antenna is tuned to match the impedance of a transmission line.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2 is a top view of a first embodiment of the antenna showing an area of conductive material divided into a first section having a square shape and a second section and a strip of conductive material having a pair of segments;

FIG. 3 is a top view of a second embodiment of the antenna showing the strip defining a plurality of closed loops;

FIG. 4 is a top view of a third embodiment of the antenna showing the strip defining an open loop;

FIG. 5 is a top view of a fourth embodiment of the antenna showing the first section having a triangular shape and the strip forming an "X" pattern;

DETAILED DESCRIPTION OF THE INVENTION

Figure 1:
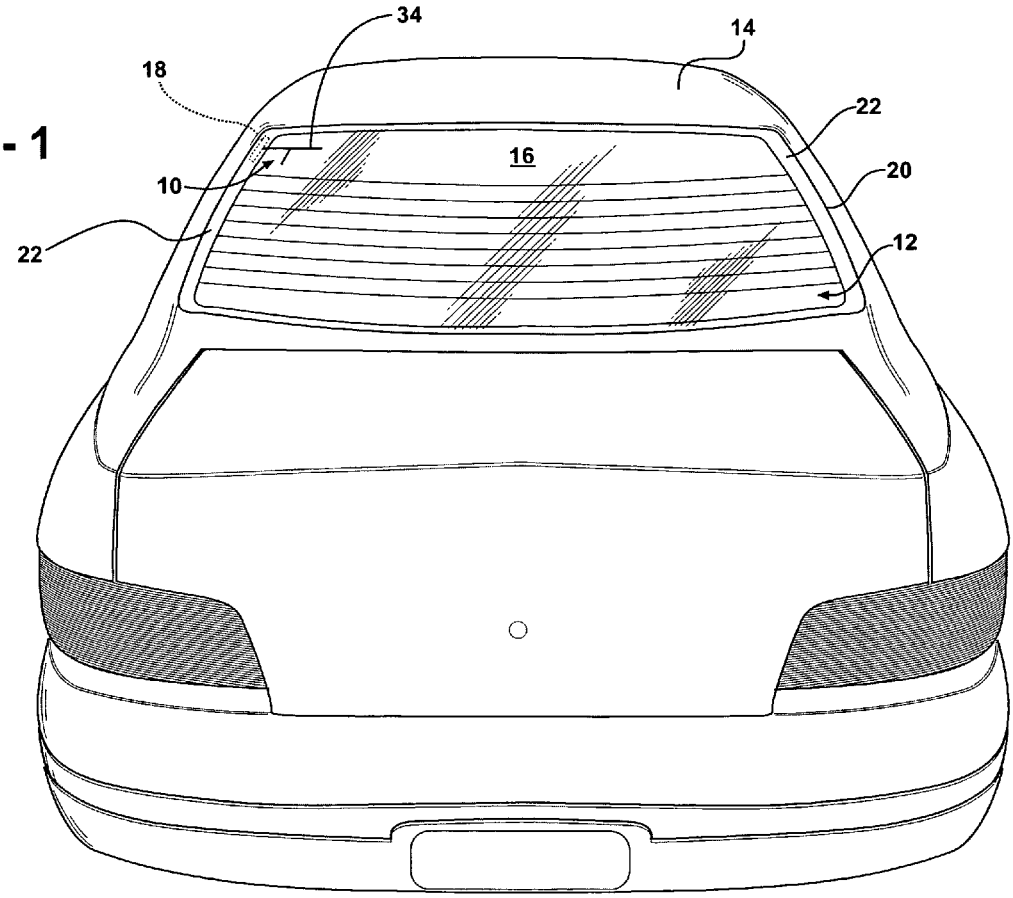
FIG. 1 is a perspective view of a vehicle including a window having an antenna disposed on a non-conductive pane.

Referring to the Figures, wherein like numerals indicate corresponding parts throughout the several views, an antenna for operating in multiple frequency bands is shown at 10. Referring to FIG. 1, the antenna 10 is preferably integrated with a window 12 of a vehicle 14. The window 12 is preferably formed of at least one non-conductive pane 16 of transparent material, such as glass. However, other materials may also be suitable for forming the transparent, non-conductive pane 16, such as, but not limited to, a resin. Those skilled in the art realize that transparent materials allow light rays to be transmitted through in at least one direction such that objects on the other side of the transparent material may be seen. The window 12 may alternatively be utilized in non-vehicle applications such as buildings (not shown). The antenna 10 may also be implemented in non-window applications, including, but not limited to, electronic devices such as cellular phones and terrestrial broadcast receivers. Of course, those skilled in the art realize other applications for the antenna 10. The antenna 10 is described hereafter as integrated with the window 12, but this should not be perceived as limiting in any way.

As stated above, the antenna 10 operates in multiple frequency bands. Particularly, the various embodiments of the antenna 10 defined herein each effectively radiate in a first frequency band and a second frequency band. Said another way, the antenna 10 exhibits an acceptable return loss and voltage standing wave ratio (VSWR) in a range of frequencies defining the first and second frequency band.

The antenna 10, as described herein, preferably radiates in frequency bands utilized for cellular/mobile telephone communications. Specifically, the first frequency band is the U.S. "PCS" band, with frequencies ranging from 1850 MHz to 1990 MHz. In the U.S., this band typically supports GSM, CDMA, and D-AMPS systems. The second frequency band is the U.S. "cellular" band, with frequencies ranging from 824 MHz to 940 MHz. In the U.S., this band typically supports AMPS, D-AMPS, CDMA, TDMA, and GSM services. Of course, the dimensions of the antenna 10, as described in further detail below, may be altered to allow operation of the antenna 10 in other frequency bands and/or additional frequency bands.

The antenna 10 includes a conductive area 18 formed of conductive material. The conductive area 18 is preferably disposed on the non-conductive pane 16. The conductive material is preferably a metal which has properties conducive to conducting electricity. Most preferably, the metal is a silver paste which is disposed on the non-conductive pane 16 in a firing process well known to those skilled in the art.

As shown in FIG. 1, windows 12 of vehicles 14 often include a region 22 around the edge 20 of the window 12 that is coated with paint or ceramic frit, typically black in color. As shown in FIG. 1, the conductive area 18 is preferably disposed adjacent an edge 20 of the window 12 of the vehicle 14. Most preferably, the conductive area 18 is disposed in the coated region 22 such that the conductive area is not easily viewable on the window 12. Thus, the conductive area 18 will not impede the vision of the driver any more than is already impeded by the coated region 22.

In the illustrated embodiments, the conductive area 18 is rectangularly-shaped. Of course, the conductive are 18 may form other shapes. The conductive area 18 includes at least one peripheral side 23.

Referring now to FIG. 2, the conductive area 18 defines a slot 24. The slot 24 interrupts the peripheral side 23 and divides the conductive area 18 into a first section 26 and a second section 28. The first section 26 is spaced from the second section 28. The second section 28 at least partially surrounds the first section 26. The second section 28 serves as a ground plane to the antenna 10. Since the conductive area 18 is disposed adjacent the edge 20 of the window 12, the metal frame (not shown) of the vehicle 14 may also serve as an extension of the ground plane due to its close proximity to the second section 28. Furthermore, the metal frame of the vehicle 14 may also be in direct contact with the second section 28.

Preferably, the antenna 10 includes a connector 29 for accepting and supporting a transmission line 30. The connector 29 includes a first contact (not shown) electrically connected to the first section 26 and a second contact (not shown) electrically connected to the second section 28. The contacts are electrically isolated from one another. Most preferably, the transmission line 30 is an unbalanced line, such as a coaxial cable. The coaxial cable includes a center conductor (not shown) and a shield (not shown). The connector 29 electrically connects the center conductor to the first section 26 and electrically connects the shield to the second section 28. Thus, the shield of the transmission line 30 is connected to the ground plane of the antenna 10.

In a first embodiment, as shown in FIG. 2, the first section 26 is generally rectangular-shaped and more specifically, square-shaped. Of course, the first section 26 may be implemented in alternative geometric shapes, including, but not limited to, triangular and circular shapes. For example, FIG. 5 illustrates a fourth embodiment of the antenna 10 showing the first section 26 as generally triangular-shaped.

The first section 26 includes at least one edge 31 adjacent to the slot 24. In the first embodiment, as shown in FIG. 2, the first section 26 includes three edges 31 adjacent to the slot 24. The second section 28 also includes at least one edge 32 adjacent to the slot. In the first embodiment, the second section 28 also includes three edges 32 adjacent to the slot 24. The edges 31, 32 and the slot 24 are dimensioned for radiating primarily in the first frequency band. Said another way, the length of the edges 31, 32 and the width of the slot 24 are dimensioned to correspond to a first group of frequencies for which it is desirous to transmit and/or receive RF signals. Specifically, the edges 31 of the first section 26 each have a length of about 10 mm. The slot 24 defines a width of about 2 mm between edges 31, 32.

The antenna 10 also includes a conductive strip 34 formed of conductive material. The term "conductive strip" 34 refers to an elongated, thin piece that is longer than it is wide. The conductive strip 34 is disposed generally co-planar with the conductive area 18. Specifically, a plane (not shown) defined by the conductive strip 34 and a plane (not shown) defined by the conductive area 18 are no more than 10 degrees offset from one another. In the illustrated embodiments, the conductive strip 34 is also disposed on the non-conductive pane 16, such that the conductive strip 34 and the conductive area 18 are therefore generally co-planar. The conductive strip 34 resembles window defroster heating lines that are common in vehicle windows. Thus, the driver of the vehicle will not significantly notice the conductive strip 34.

The conductive strip 34 is connected to the first section 26 of the conductive area 18 along the peripheral side 23 of the conductive area 18. The conductive strip 34 is dimensioned for radiating primarily in the second frequency band. In the first embodiment, the conductive strip 34 includes a first segment 36 connected to the first section 26 and extending perpendicularly from the first section 26. Specifically, the connection of the first segment 36 is generally equidistant from the slot 24.

The conductive strip 34 also includes a second segment 38 connected to the first segment 36 and extending generally perpendicular from the first segment 36. As such, the second segment 38 is generally parallel to the peripheral side 23 of the area 18. In the first embodiment, for operating on the frequencies described above, the first segment 36 defines a length of about 62 mm and the second segment 38 defines a length of about 31 mm. The second segment 38 intersects with the first segment 36 at a point about 31 mm from the peripheral side 23 of the conductive area 18. Either the first or second segments 36, 38 can be used for tuning the antenna as a tuning stub. That is, the length of either of the segments 36, 38 can be extended or reduced to properly match the impedance of the antenna to the impedance of a coaxial cable, which is typically around 50Ω.

The antenna 10 of the first embodiment provides impressive performance characteristics. The antenna 10 achieves a return loss as low as 14 dB in the first frequency band and a return loss between 10 and 22 dB in the second frequency band. This translates to a VSWR of less than 2:1 in both frequency bands.

It may be convenient to conceptualize the antenna 10 of the subject invention as a dipole antenna 10. The dipole antenna 10 includes a first dipole leg (not numbered) and a second dipole leg (not numbered). The first dipole leg radiates primarily in the first frequency band and is formed by the edges 31, 32 of conductive material adjacent the slot 24. The second dipole leg radiates primarily in the second frequency band and is formed by the conductive strip 34.

Of course, the dipole legs do not radiate independently of one another; that is, the dipole antenna 10 must be treated as a consolidated unit. The geometric dimensions of the first dipole leg have an effect on the performance of the antenna 10 in the second frequency band. Likewise, the geometric dimensions of the second dipole leg have an effect on the performance of the antenna 10 in the first frequency band. Changes to the geometric dimensions of just about any component of the antenna 10 will have an effect on the performance of the antenna 10.

FIG. 3 illustrates a second embodiment of the invention. In the second embodiment, the conductive strip 34 forms at least one closed loop 40 of conductive material. The term "closed loop" refers to the conductive strip 34 forming a polygon. The at least one closed loop 40 may form any of several shapes. In the second embodiment, the conductive strip 34 forms three closed loops 40 forming rectangular shapes of various dimensions. Each closed loop 40 is made up of various segments (not numbered). One of the closed loops 40 may share one or more segments, or part of segments, with another of the closed loops 40.

The conductive strip 34 may also include various segments (not numbered) that are not part of one of the closed loops 40. For instance, as shown in FIG. 3, the conductive strip 34 includes segments connecting the closed loops 40 to the first section 26. The conductive strip 34 also includes segments extending from one of the closed loops 40 and functioning as tuning stubs.

The antenna 10 of the second embodiment also provides excellent performance characteristics. The antenna 10 achieves a return loss of nearly 20 dB in the first frequency band and a return loss between 10 and 16 dB in the second frequency band. Again, this translates to a VSWR of less than 2:1 in both frequency bands.

FIG. 4 illustrates a third embodiment of the present invention. In the third embodiment, the conductive strip 34 forms an open loop 42 of conductive material. Specifically, the conductive strip 34 includes a first segment 44 having a proximal end 46 and a distal end 48. The proximal end 46 is connected to the first section 26 of the area 18 and the first segment extends from the peripheral side 23. A second segment 50 includes a proximal end 52 and a distal end 54. The proximal end 52 is connected to the distal end 48 of the first segment 44. The second segment 50 extends perpendicularly from the first segment 44. A third segment 56 includes a proximal end 58 and a distal end 60. The proximal end 58 is connected to the distal end 54 of the second segment 50. The third segment 56 extends perpendicularly from the second segment 50 and towards the area 18. The conductive strip 34 also includes a fourth segment 62 having a proximal end 64 and a distal end 66. The fourth segment 62 is connected to the first segment 44 at a point 68 between the proximal and distal ends 46, 48 of the first segment 44. The fourth segment 62 extends generally perpendicular from the first segment 44 and towards the distal end 60 of the third segment 56. A gap 70 is defined between the distal end 66 of the fourth segment 62 and the distal end 60 of the third segment 56.

The antenna 10 of the third embodiment may also include a stub 72 having a proximal end 74 and a distal end 76 extending away from the peripheral side 23 of the conductive area 18 and towards the gap 70 defined between the third and fourth segments 56, 62. The proximal end 74 is connected to the second section 28. The distal end 76 terminates at a point about equidistant from the distal end 60 of the third segment 56 and the distal end 66 of the fourth segment 62.

The first, second, and third segments 44, 50, 56 assist in providing the antenna 10 of the third embodiment resonance at the second frequency band. The fourth segment 62, the stub 72, and a portion (not numbered) of the first segment 44 between the proximal end 46 and the fourth segment 62 assist in providing the antenna 10 resonance at the first frequency band.

The antenna 10 of the third embodiment provides excellent performance. The antenna 10 achieves a return loss of 14 dB at 824 MHz and 20 dB at 894 MHz, both in the second frequency band. Furthermore, the return loss dips to 30 dB between the above frequencies in the second frequency band. The antenna 10 also provides a return loss of 27 dB at 1.85 GHz and around 35 dB elsewhere in the first frequency band. The return loss values translate to VSWRs of less than 1.4:1 in both frequency bands.

A fourth embodiment of the invention is illustrated in FIG. 5. In this embodiment, the first section 26 is triangularly-shaped. The triangularly-shaped first section 26 includes at least two edges 31 adjacent to the slot 24. However, in the fourth embodiment, all three edges 31 of the triangularly-shaped first section 26 are adjacent to the slot to define the slot 24. The edges 32 of the second section 28 of the fourth embodiment define a generally square shape. As such, portions of the slot 24 define a variable width between the sections 26, 28. Specifically, the width of the slot 24 is highest adjacent the peripheral side 23 of the conductive area 18. The triangularly-shaped first section 26 provides wideband characteristics to the antenna 10 which allow the antenna 10 to be easily tuned.

The conductive strip 34 of the fourth embodiment presents an "X" or cross-shaped feature. Specifically, the conductive strip 34 includes a first segment 78 having a proximal end 80 and a distal end 82. The proximal end 80 is connected to the first section 26 at the peripheral side 23 and extends generally perpendicular from the area 18. A second segment 84 intersects with the distal end 82 of the first segment at an intersection point 86. A third segment 88 intersects with the second segment 84 at the intersection point 86. The second and third segments 84, 88 define the "X" or cross shape of this embodiment. Preferably, the second and third segments 84, 88 each define a 45° angle with the first segment 78. The second segment 84 also includes a pair of ends 90. A fourth segment 92 extends towards the area 18 of conductive material from one of the ends 90 of the second segment 84. The fourth segment 92 is preferably disposed generally parallel to the first segment 78, however, this parallel disposition is not strictly required.

The first segment 78, the fourth segment 92, and a portion of the second segment 84 between the intersection point 86 and the fourth segment 92 provide resonance at the second frequency band. The first, second, and third segments 78, 84, 88 provide resonance at the first frequency band. The antenna 10 of the fourth embodiment also provides superb performance. The antenna 10 achieves a return loss of 11 dB at 824 MHz and 12 dB at 894 MHz while dipping to 30 dB in the second frequency band. The antenna 10 also provides a return loss of 12 dB at 1.85 GHz. The return loss values translate to VSWRs of less than 1.8:1 in both frequency bands.

Figure 6:
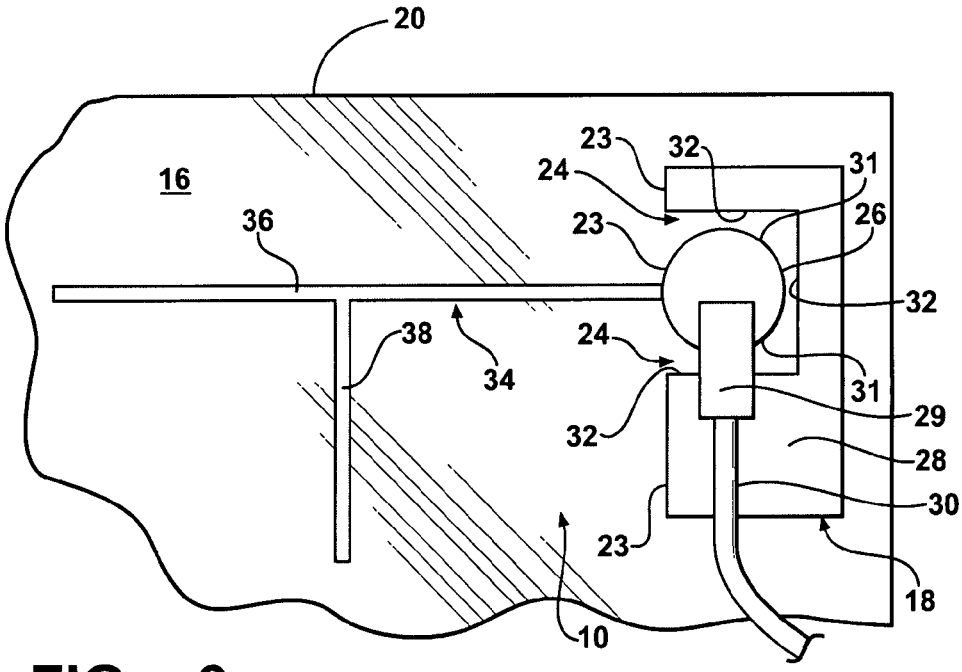
FIG. 6 is a top view of a fifth embodiment of the antenna showing the first section having a circular shape.

FIG. 6 illustrates a fifth embodiment of the invention. In the fifth embodiment, the first section 26 defines a circular-shape. As such, the first section 26 has a single, continuous edge 31.

Figure 7:
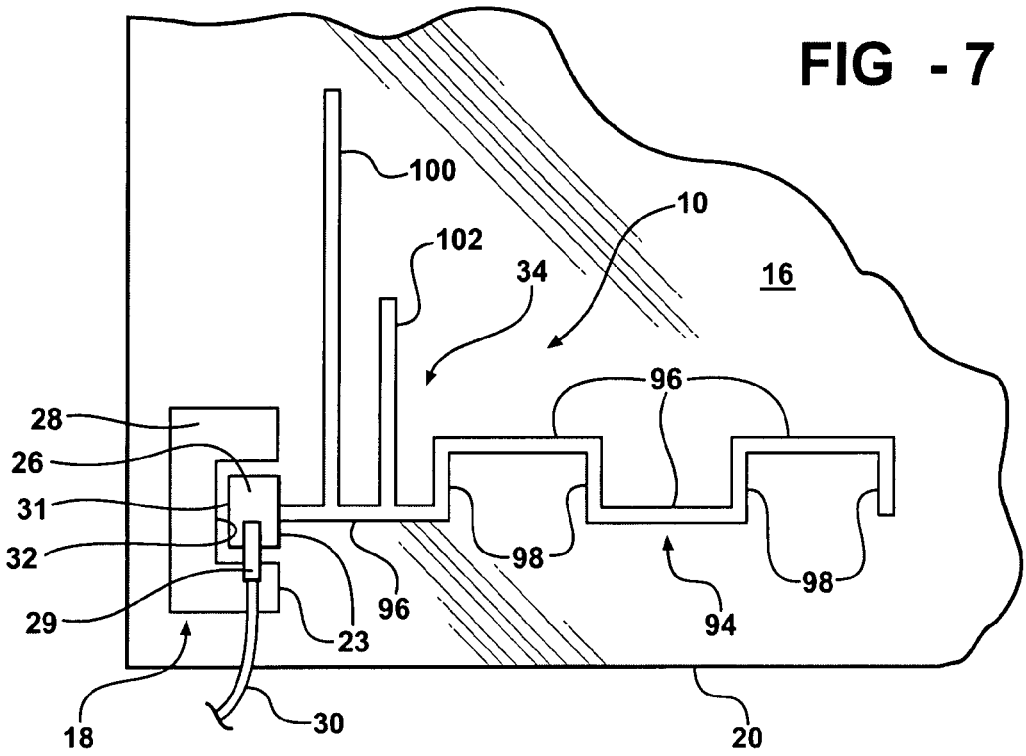
FIG. 7 is a top view of a sixth embodiment of the antenna showing the strip forming a meander line and monopole branches extending from the meander line.

FIG. 7 illustrates a sixth embodiment of the invention. In the sixth embodiment, the conductive strip 34 includes a meander line 94. The meander line 94 extends "upwards" and downwards" as the conductive strip 34 extends away from the first section 26. Specifically, the meander line 94 includes at least one horizontal component 96 and at least one vertical component 98. In the embodiment illustrated in FIG. 7, the meander line 94 includes four horizontal components 96 and four vertical components 98. The horizontal components 96 are generally perpendicular to the peripheral side 23 of the conductive area 18 while the vertical components 98 are generally parallel to the peripheral side 23. The length of each horizontal component is 25.2 mm and the length of each vertical component is 12.5 mm. Of course, the number and lengths of the components 96, 98 are determined by performance requirements and the desired frequency bands and may be different based on the specific application.

The antenna 10 of the sixth embodiment also includes a first monopole branch 100 and a second monopole branch 102. The monopole branches 100, 102 may serve to assist the resonance of the antenna 10 at specific frequencies and/or to match the impedance of the antenna 10 to the impedance of the transmission line 30. The first monopole branch 100 extends from the meander line 94. Specifically, in the embodiment illustrated in FIG. 7, the first monopole branch 100 extends generally perpendicularly from the horizontal component 96 adjacent the first section 26 of the conductive area 18. The first monopole branch 100 preferably has a length of 76.9 mm. The second monopole branch 102 also extends generally perpendicular from the meander line 94 and specifically from the horizontal component 96 adjacent the first section 26. The second monopole branch 102 preferably has a length of 40.6 mm. The antenna 10 of this sixth embodiment achieves a return loss greater than or equal to 10 dB and a VSWR of less than 2:1 in the first and second frequency bands.

Figure 8:
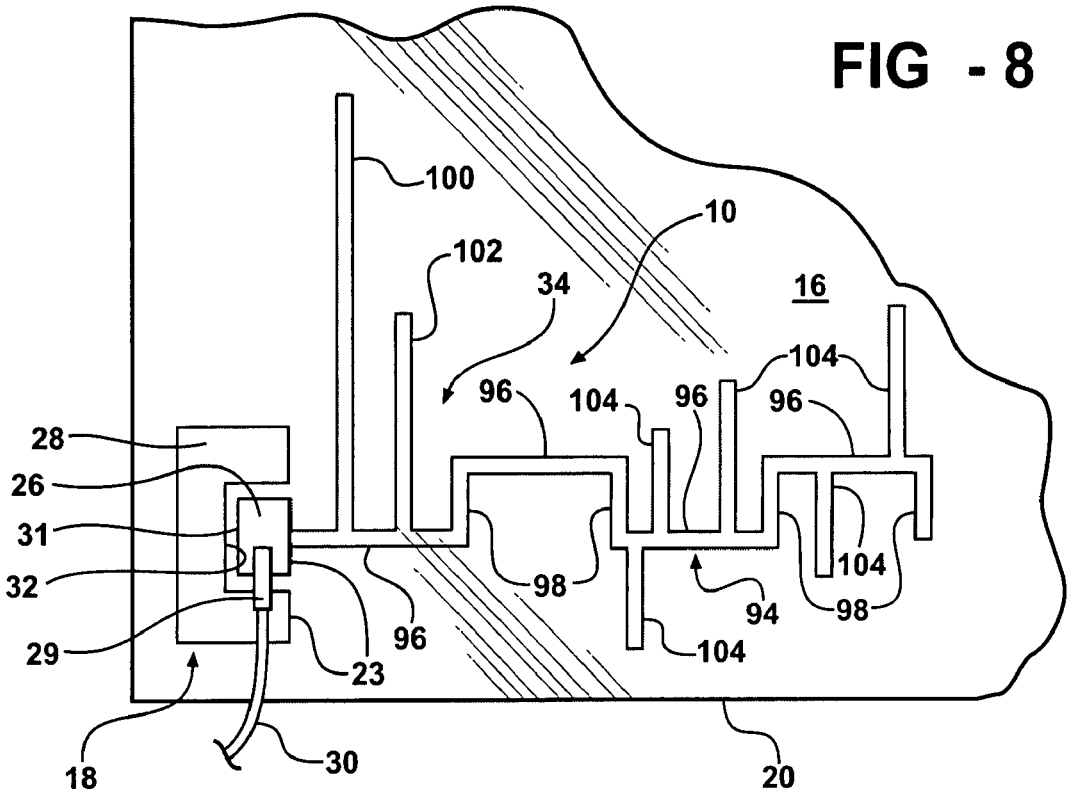
FIG. 8 is a top view of the sixth embodiment of the antenna showing additional monopole branches extending from the meander line.

Those skilled in the art realize that the length, position, and intersection angles of the monopole branches 100, 102 may be different based on the specific application. Furthermore, additional monopole branches 104 may also be utilized, as is shown in FIG. 8. As with the first and second monopole branches 100, 102, these additional monopole branches 104 assist the antenna 10 in resonance on additional frequencies.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A window having an integrated antenna for operating in a first frequency band and a second frequency band, said window comprising:

a non-conductive pane;

a conductive area formed of a conductive material and disposed on said non-conductive pane;

said conductive area having at least one peripheral side and defining a slot interrupting said peripheral side and dividing said conductive area into a first section and a second section spaced from said first section with said second section at least partially surrounding said first section;

said first section having at least one edge adjacent to said slot and said second section having at least one edge adjacent to said slot wherein said edges adjacent to said slot are dimensioned for radiating primarily in the first frequency band;

a conductive strip formed of conductive material and disposed on said non-conductive pane; and said conductive strip connected to said first section along said peripheral side and wherein said conductive strip is dimensioned for radiating primarily in the second frequency band.

2. A window as set forth in claim 1 wherein said first section is generally rectangularly-shaped such that said slot defines a generally constant width between said sections.

3. A window as set forth in claim 2 wherein said rectangularly-shaped first section includes three edges adjacent to said slot.

4. A window as set forth in claim 1 wherein said first section is triangularly-shaped such that portions of said slot defines a variable width between said sections.

5. A window as set forth in claim 4 wherein said triangularly-shaped first section includes at least two edges adjacent to said slot.

6. A window as set forth in claim 1 wherein said conductive strip includes a first segment connected to said first section and extending from said first section and a second segment connected to said first segment and extending generally perpendicular from said first segment.

7. A window as set forth in claim 1 wherein said conductive strip forms at least one closed loop of conductive material.

8. A window as set forth in claim 1 wherein said conductive strip includes a first segment having a proximal end and a distal end with said proximal end connected to said first section, a second segment intersecting with said distal end of said first segment at an intersection point, and a third segment intersecting with said second segment at said intersection point.

9. A window as set forth in claim 8 wherein said second segment includes a pair of ends and wherein said conductive strip further includes a fourth segment extending towards said conductive area from one of said ends of said second segment and disposed generally parallel to said first segment.

10. A window as set forth in claim 1 wherein said conductive strip forms an open loop of conductive material.

11. A window as set forth in claim 1 wherein said conductive strip includes a first segment extending from said peripheral side and having a proximal end connected to said first section and a distal end, a second segment extending perpendicularly from said first segment and having a distal end and a proximal end connected to said distal end of said first segment, and a third segment extending perpendicularly from said second segment and towards said conductive area and having a distal end and a proximal end connected to said distal end of said second segment.

12. A window as set forth in claim 11 wherein conductive strip further includes a fourth segment extending away from said first segment and having a distal end and a proximal end connected to a point on said first segment between said proximal and distal ends of said first segment to define a gap between said distal end of said fourth segment and said distal end of said third segment.

13. A window as set forth in claim 12 further comprising a stub extending away from said peripheral side towards said gap defined between said third and fourth segments and having a distal end and a proximal end connected to said second section.

14. A window as set forth in claim 1 wherein said conductive strip forms a meander line.

15. A window as set forth in claim 14 further comprising at least one monopole branch extending from said meander line.

16. An antenna comprising:

a conductive area formed of a conductive material;

said area of conductive material having at least one peripheral side and defining a slot interrupting said peripheral side and dividing said area into a first section and a second section spaced from said first section with said second section at least partially surrounding said first section;

said first section having at least one edge adjacent to said slot and said second section having at least one edge adjacent to said slot wherein said edges adjacent to said slot are dimensioned for radiating primarily in the first frequency band;

a conductive strip formed of conductive material and disposed generally co-planar with said conductive area; and said conductive strip connected to said first section along said peripheral side and wherein said conductive strip is dimensioned for radiating primarily in the second frequency band.

17. An antenna as set forth in claim 16 wherein said first section is generally rectangularly-shaped such that said slot defines a generally constant width between said sections.

18. An antenna as set forth in claim 17 wherein said rectangularly-shaped first section includes three edges adjacent to said slot.

19. An antenna as set forth in claim 16 wherein said first section is triangularly-shaped such that portions of said slot defines a variable width between said sections.

20. An antenna as set forth in claim 19 wherein said triangularly-shaped first section includes at least two edges adjacent to said slot.

21. An antenna as set forth in claim 16 wherein said conductive strip includes a first segment connected to said first section and extending from said first section and a second segment connected to said first segment and extending generally perpendicular from said first segment.

22. An antenna as set forth in claim 16 wherein said conductive strip forms at least one closed loop of conductive material.

23. An antenna as set forth in claim 16 wherein said conductive strip forms an open loop of conductive material.

24. An antenna as set forth in claim 16 wherein said conductive strip forms a meander line.

25. A dipole antenna for operating in a first frequency band and a second frequency band comprising:

a first dipole leg for radiating primarily in the first frequency band and formed by edges of conductive material adjacent a slot defined through a conductive area having at least one peripheral side wherein said slot interrupts said peripheral side and divides said conductive area into a first section and a second section such that said sections are spaced apart from one another with said second section at least partially surrounding said first section; and a second dipole leg for radiating primarily in a second frequency band and formed by a conductive strip disposed generally co-planar with said conductive area and connected to said first section along said peripheral side.

* * * * *

UNITED STATES PATENT AND TRADEMARK OFFICE

CERTIFICATE OF CORRECTION

PATENT NO. : 7,586,452 B2
APPLICATION NO. : 11/874733
DATED : September 8, 2009
INVENTOR(S) : Qian Li et al.

It is certified that error appears in the above-identified patent and that said Letters Patent is hereby corrected as shown below:

Column 9, line 14, after "in," delete "the" insert therein -- a -- before "first".

Column 9, line 21, after "in," delete "the" insert therein -- a -- before "second".

Column 10, line 27, after "in," delete "the" insert therein -- a -- before "second".

Signed and Sealed this

Nineteenth Day of January, 2010

David J. Kappos

David J. Kappos
*Director of the United States Patent and Trademark Office*